US010819022B1

(12) United States Patent
Milroy et al.

(10) Patent No.: US 10,819,022 B1
(45) Date of Patent: Oct. 27, 2020

(54) PARTITIONED VARIABLE INCLINATION CONTINUOUS TRANSVERSE STUB ARRAY

(71) Applicant: ThinKom Solutions, Inc., Hawthorne, CA (US)

(72) Inventors: William Milroy, Torrance, CA (US); Alan Lemons, San Pedro, CA (US)

(73) Assignee: ThinKom Solutions, Inc., Hawthorne, CA (US)

( * ) Notice: Subject to any disclaimer, the term of this patent is extended or adjusted under 35 U.S.C. 154(b) by 0 days.

(21) Appl. No.: 16/589,203

(22) Filed: Oct. 1, 2019

(51) Int. Cl.
*H01Q 21/00* (2006.01)
*H01Q 1/28* (2006.01)
*H01Q 13/06* (2006.01)

(52) U.S. Cl.
CPC ..... *H01Q 1/283* (2013.01); *H01Q 13/065* (2013.01)

(58) Field of Classification Search
CPC ..... H01Q 1/283; H01Q 13/065; H01Q 1/42; H01Q 3/08; H01Q 1/28; H01Q 21/0031; H01Q 3/24; H01Q 13/28; H01Q 21/28
See application file for complete search history.

(56) References Cited

U.S. PATENT DOCUMENTS 6,919,854 B2 7/2005 Milroy et al.
9,972,915 B2 5/2018 Milroy et al.
2015/0061795 A1* 3/2015 Milroy ..... H01P 3/023 333/24 R
2015/0171515 A1* 6/2015 Milroy ..... H01Q 21/0031 343/756
2018/0069321 A1* 3/2018 Milroy ..... H01Q 21/0025

* cited by examiner

*Primary Examiner* — Dameon E Levi
*Assistant Examiner* — David E Lotter
(74) *Attorney, Agent, or Firm* — Kusner & Jaffe

(57) ABSTRACT

A variable inclination continuous transverse stub antenna includes a first conductive plate and a second conductive plate spaced relative to the first conductive plate. The first conductive plate includes a first surface partitioned into a first region and a second different region, a first group of CTS radiators on the first region, and a second group of CTS radiators on the second region. A spacing and a width in an E-field direction of the first group of radiators is different in respect to a spacing and width in the E-field direction of the second group of radiators. The second conductive plate includes a second surface parallel to the first surface, the second surface partitioned into a first parallel plate transmission line and a second different parallel plate transmission line, the first and second parallel plate transmission lines configured to receive or output a different radio frequency signals from one another.

20 Claims, 11 Drawing Sheets

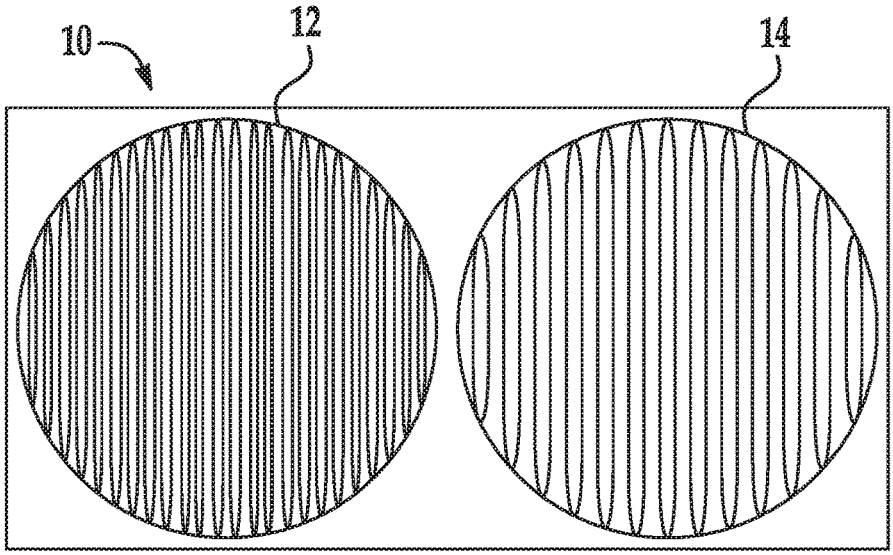
FIG. 1A
(CONVENTIONAL)
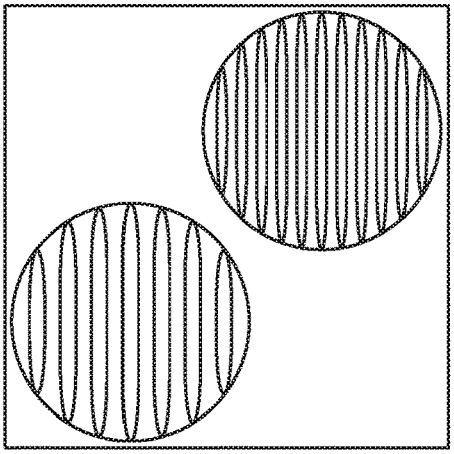
FIG. 1B
(CONVENTIONAL)
(PARTITIONED)

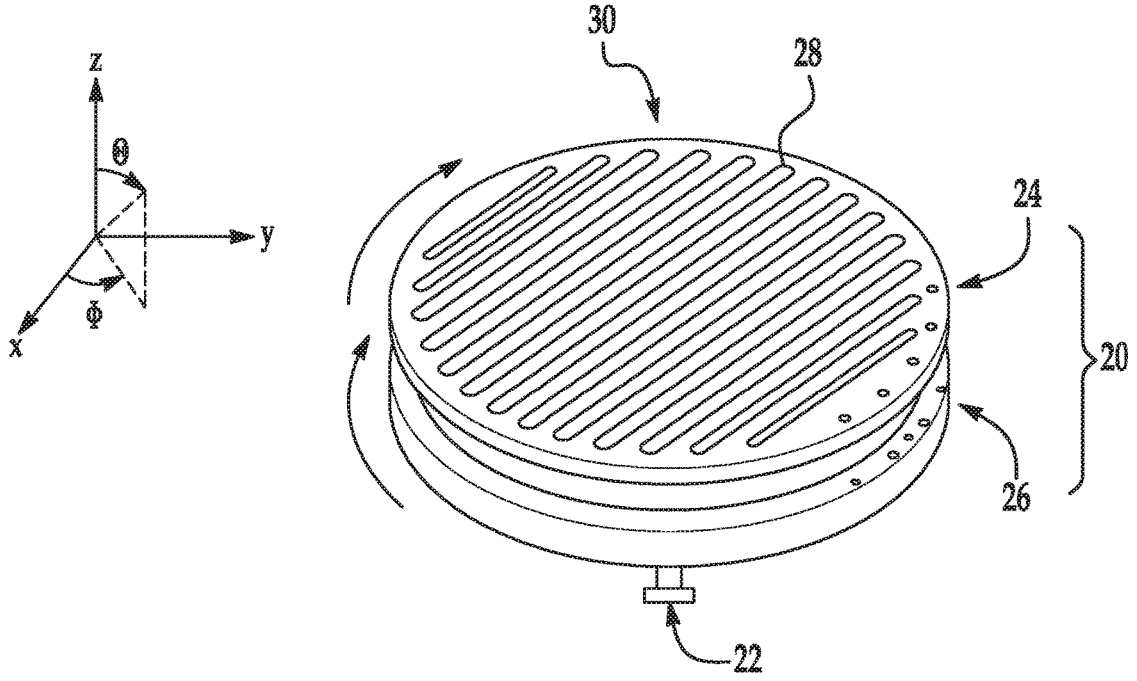
FIG. 2
(CONVENTIONAL)

PARTITIONED VARIABLE INCLINATION CONTINUOUS TRANSVERSE STUB ARRAY

TECHNICAL FIELD

The present invention relates generally to antennas, and more particularly, to a partitioned variable inclination continuous transverse stub antenna.

BACKGROUND ART

Variable inclination continuous transverse stub (VICTS) antenna arrays, due to their inherent low profile and low volume footprint, are a proven antenna solution for systems with demanding installation and packaging requirements. One common installation footprint includes a long (rectangular) narrow volume compatible with aeronautical fuselage crown mount configurations. Another common installation footprint includes a square volume typical of that available on an aircraft wing or terrestrial automobile roof mount configurations.

FIG. 1A shows a top view of an exemplary dual VICTS installation 10, whereby two VICTS arrays 12, 14 are placed side-by-side in a way that lends itself to a long narrow volume installation. In this configuration, one VICTS array 12 may support a data uplink function using one frequency band while the other VICTS array 14 may support a data downlink function using another frequency band. Alternatively, each array 12, 14 may support different polarizations in the same operating frequency band. Each array 12, 14 operates as an independent entity with the ability to achieve unique scan angles and polarizations in two separate independent frequency bands.

Conventional antenna arrays have utilized the concept of feeding a partitioned VICTS array with separate feeds to support two polarizations at the same frequency band, not two separate frequency bands, the latter of which presents additional key design challenges

SUMMARY OF INVENTION

When a square (or generally more compact) installation volume and maximum antenna gain are required, two side-by-side VICTS arrays may not provide the most effective filling of such a square volume, 55% or less as shown in FIG. 1B. A single partitioned VICTS array 16 as shown in FIG. 1C having a mechanically common but electrically-partitioned circular aperture, but utilizing separate feeds and parallel plate regions to support separate frequency bands would exhibit similar, desirable performance attributes (e.g., wide frequency band coverage, near hemispherical scan volume and polarization diversity) as two non-partitioned VICTS arrays oriented diagonally to fit within the volume, but would provide more antenna gain at less weight and cost as compared to that of the dual configuration.

A device and method in accordance with the invention enable operation of a VICTS array at two widely dispersed frequency bands within the same VICTS array. In accordance with the invention, a novel partitioned VICTS architecture utilizes choking and aperture design features to enable each partitioned region to function as an independent antenna at a different frequency band without degrading the neighboring region (antenna). In addition, polarization of each independent VICTS region may be simultaneously modified by incorporating a single polarizer that resides above both VICTS regions or by incorporating a polarizer partitioned into separate regions that would also reside above both VICTS regions. As with an un-partitioned VICTS array, antenna main beam scanning with the partitioned VICTS is achieved by rotating the aperture with respect to the feed.

In accordance with the invention, a VICTS aperture, parallel plate transmission line, feed, and polarizer are partitioned into two or more regions. Each VICTS aperture region independently services a different frequency band. In this regard, each aperture region is configured separately with a parallel plate transmission line feed that services that aperture region and its respective frequency band. This novel approach can provide unique polarizations (circular polarization, linear polarization, etc. . . . ) to each partitioned region of the aperture through a partitioned polarizer architecture.

In one embodiment, a unique radio frequency choking device is utilized to isolate the regions operating at different frequency bands from one another. Further, the aperture regions at each band may be nominally designed so that their antenna main beams are oriented to support co-aligned operation at both bands simultaneously.

To minimize degradation due to rotational aperture overlap, a condition wherein the stubs are designed to operate in one frequency band partially overlay the feed/parallel-plate region dedicated to another frequency band at certain rotational positions of the aperture, an intermediate rotation angle can be chosen for the no-overlap case. This angle can be adjusted to balance and optimize scan volume performance between the two partitioned halves of the antenna, taking into account the specific design requirements with respect to antenna gain and pattern performance over the respective operating frequency bands and over the desired antenna scan range The combination of a VICTS aperture, parallel transmission line, and feed partitioned into two or more separate regions, each operating at different frequency bands along with the optimized no-overlap aperture rotation, forms another novel embodiment. Additional embodiments can be formed by adding a partitioned polarizer to the partitioned feed/aperture embodiment and employing similar intermediate rotation angle selection criteria. With the added polarizer, multiple frequency band operation and multiple polarization operation are achieved in one antenna, providing the VICTS array designer maximum packaging flexibility when dealing with constrained installation volumes.

With its superior ohmic efficiency, wide angle scanning capability, and polarization diversity, the partitioned VICTS array in accordance with the invention provides another packaging option for applications where it may not be possible to accommodate two separate VICTS arrays. Also, the partitioned VICTS architecture is achieved with less hardware than a dual VICTS, leading to significant (approximately 50%) weight savings.

According to one aspect of the invention, a variable inclination continuous transverse stub (VICTS) antenna, comprises: a first conductive plate structure comprising a first surface partitioned into a first aperture region and a second aperture region different from the first aperture region, a first group of continuous transverse stub (CTS) radiators arranged on the first aperture region, and a second group of CTS radiators arranged on the second aperture region, wherein a spacing and a width in an E-field direction of the first group of CTS radiators is different with respect to a spacing and a width in the E-field direction of the second group of CTS radiators; and a second conductive plate structure disposed in a spaced relationship relative to the first conductive plate structure, the second conductive plate structure comprising a second surface parallel to the first surface, wherein the second surface is partitioned into a first region and a second region different from the first region, wherein a first parallel plate transmission line portion of the antenna is formed between the first regions of the first and second conductive plate structures, and a second parallel plate transmission line portion different from the first parallel plate transmission line portion is formed between the second regions of the first and second conductive plate structures, the first and second parallel plate transmission line portions configured to receive or output a different radio frequency (RF) signals from one another.

In one embodiment, the first and second group of CTS radiators are arranged on the first and second aperture regions, respectively, to orient a longitudinal axis of the first and second group of CTS radiators at a predefined non-zero angle with respect to a partition line that separates the first aperture region from the second aperture region.

In one embodiment, the first aperture region and the second aperture region are unequal in size.

In one embodiment, a surface area of the first aperture region is unequal to a surface area of the second aperture region.

In one embodiment, the antenna further includes a choke arranged relative to the first and second conductive plate structures, the choke partitioning the second conductive plate structure to define the first and second parallel plate transmission line portions.

In one embodiment, the choke spans an entire length of the second conductive plate structure.

In one embodiment, the choke comprises a V-shape.

In one embodiment, the first parallel plate transmission line portion and the second parallel plate transmission line portion are unequal in size.

In one embodiment, a surface area of the second conductive plate structure defined by the first parallel plate transmission line portion is unequal to a surface area of the second conductive plate structure defined by the second parallel plate transmission line portion.

In one embodiment, the first parallel plate transmission line portion spans a first angular extent and the second parallel plate transmission line portion spans a second angular extent, the second angular extent different from the first angular extent.

In one embodiment, the antenna includes a first port for receiving or outputting a first RF signal, and a first subarray formed on the first parallel plate transmission line portion, the first subarray communicatively coupled to the first port.

In one embodiment, the antenna includes a second port for receiving or outputting a second RF signal, and a second subarray formed on the second parallel plate transmission line portion, the second subarray communicatively coupled to the second port.

In one embodiment, the antenna includes more than one subarray formed on the first parallel plate transmission line portion communicatively coupled to the first port and more than one subarray formed on the second parallel plate transmission line portion communicatively coupled to the second port.

In one embodiment, the antenna includes a polarizer disposed over the first conductive plate structure.

In one embodiment, the polarizer includes a first polarizer partition comprising a first type of polarizer, and a second polarizer partition comprising a second type of polarizer different from the first type of polarizer.

In one embodiment, the first type of polarizer comprises a linear-to-left circular polarizer and the second type of polarizer comprises a linear-to-right circular polarizer.

In one embodiment, the first conductive plate and the second conductive plate are concentric with one another.

In one embodiment, the first conductive plate and the second conductive plate are rotatable relative to one another about a common axis.

In one embodiment, the first conductive plate and the second conductive plate comprise a circular form factor.

According to another aspect of the invention, a method of transmitting and receiving multiple RF signals having different frequency bands using the VICTS antenna according to any one of claims 1-22, the method including: receiving at one of the first parallel plate transmission line portion or the first aperture region a first RF signal having a first frequency band; receiving at one of the second parallel plate transmission line portion or the second aperture region a second RF signal having a second frequency band that is different from the first frequency band; communicating the first RF signal between the first parallel plate transmission line portion and the first aperture region; communicating the second RF signal between the second parallel plate transmission line portion and the second aperture region; and outputting the first RF signal at the other of the first parallel plate transmission line portion or the first aperture region, and outputting the second RF signal at the other of the second parallel plate transmission line portion or the second aperture region.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

FIG. 1A is a schematic diagram of a conventional dual VICTS array in a long/narrow (rectangular) installation volume.

FIG. 1B is a schematic diagram of a conventional dual VICTS array in a square installation volume.

FIG. 2 is an exploded view of a conventional VICTS array.

DETAILED DESCRIPTION OF INVENTION

Figure 1C:
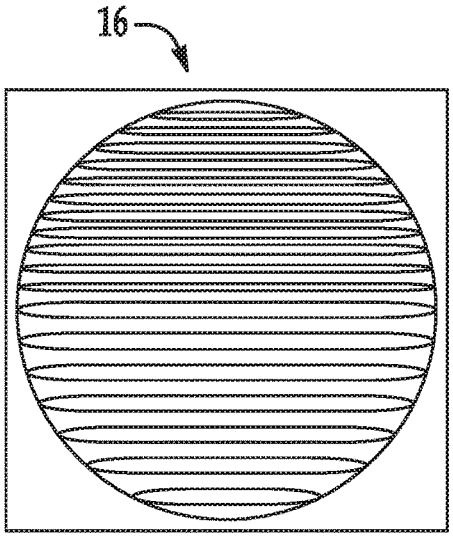
FIG. 1C is a schematic diagram of a partitioned VICTS array in the same square installation volume as shown in FIG. 1B.

Embodiments of the present invention will now be described with reference to the drawings, wherein like reference numerals are used to refer to like elements throughout. It will be understood that the figures are not necessarily to scale.

A VICTS antenna in its simplest form is comprised of two concentric conducting plates, one containing an aperture and one containing a feed. With reference to FIG. 2, illustrated is an exploded view of a typical VICTS antenna 20 embedded in a spherical coordinate system. The VICTS antenna 20 includes a port 22 for receiving/outputting an RF signal, and lower and upper conducting plates 24 and 26 as is conventional. The upper conducting plate 24 includes a plurality of stubs 28 that define an aperture 30 of the VICTS antenna 20. Antenna main beam scanning in θ is achieved via the differential rotation of the aperture with respect to the feed. This type of rotation also scans the antenna main beam over a small range of ϕ (azimuth), while additional desired scanning in ϕ is achieved by rotating the aperture and feed simultaneously, leading to near hemispherical scan coverage.

Figure 3A:
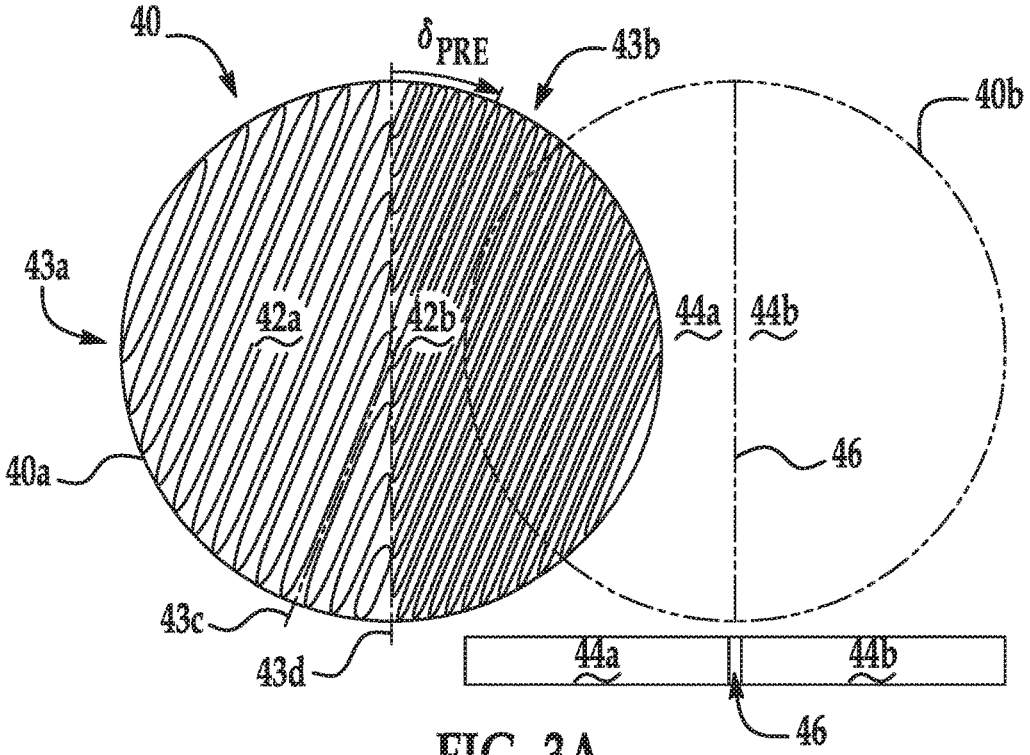
FIG. 3A is an exploded top view of a two-region VICTS array in accordance with an embodiment of the invention.

Referring now to FIG. 3A, illustrated is an exploded top view of a two-region VICTS array 40 along with a side view in accordance with an embodiment of the invention. In the embodiment of FIG. 3A, the VICTS array 40 includes a first conductive plate structure 40*a* and a second conductive plate structure 40*b* disposed in a spaced relationship relative to the first conductive plate structure, the conductive plate structures being rotatable relative to one another about a common axis. To minimize the footprint of the VICTS array 40, it is preferable that the first and second conductive plate structures have circular form factors and are concentric with one another. A surface of the first conductive plate structure 40*a* is partitioned into two equal sized regions; first aperture region 42*a*, second aperture region 42*b*. The first aperture region 42*a* includes a first group of CTS radiators 43*a* and the second aperture region 42*b* includes a second group of CTS radiators 43*b*. A spacing and a width in an E-field direction (perpendicular to the continuous stub radiator axes) of the first group of CTS radiators 43*a* is different in respect to a spacing and width in the E-field direction of the second group of CTS radiators 43*b*.

In the embodiment of FIG. 3A, the first and second group of CTS radiators 43*a*, 43*b* are arranged on the first and second aperture regions 42*a*, 42*b*, respectively, to orient a longitudinal axis 43*c* of the first and second group of CTS radiators 43*a*, 43*b* at a predefined non-zero angle with respect to an aperture partition line 43*d* that separates the first aperture region 42*a* from the second aperture region 42*b*.

A surface of the second conductive plate structure 40*b*, which is parallel to the surface of the first conductive plate structure 40*a*, forms a parallel plate transmission line between the first and second conductive plate structures. The second conductive plate structure 40*b* is partitioned to define a first parallel plate transmission line portion 44*a* and a second parallel plate transmission line portion 44*b*, the first and second parallel plate transmission line portions configured to receive or output different radio frequency (RF) signals from one another. For example, the first parallel plate transmission line portion 44*a* can be designed to work at a first frequency band BW1 and the second parallel plate transmission line portion 44*b* can be designed to work at a second frequency band BW2. Similarly, the first aperture region 42*a* can be designed to work at the first frequency band BW1 and the second aperture region 42*b* can be designed to work at the second frequency band BW2. A unique bidirectional dual-frequency RF choke 46, which serves to electrically partition and isolate the two adjacent parallel-plate transmission line regions (44*a* and 44*b*) of disparate frequencies of operation, without physical contact between the first and second parallel plate structures (40*a* and 40*b*) is deployed on the second conductive plate structure 40*b* between the first parallel plate transmission line portion 44*a* and the second parallel plate transmission line portion 44*b* to minimize interference between the two partitioned regions. The choke 46 spans the entire length of the second conductive plate structure 40*b*, e.g., from a radial edge at a first location of the second conductive plate structure to a radial edge at another location on the second conductive plate structure. By spanning the entire length of the second conductive plate structure 40*b*, the choke 46 partitions the second conductive plate structure 40*b* to define the first and second parallel plate transmission line portions 44*a*, 44*b*. In FIG. 3A the choke 46 bisects the second conductive plate structure 40*b* into two equal portions, although the choke 46 may be arranged in different locations and/or have different shapes to create unequal portions as discussed with respect to FIGS. 6-11.

Figure 4:
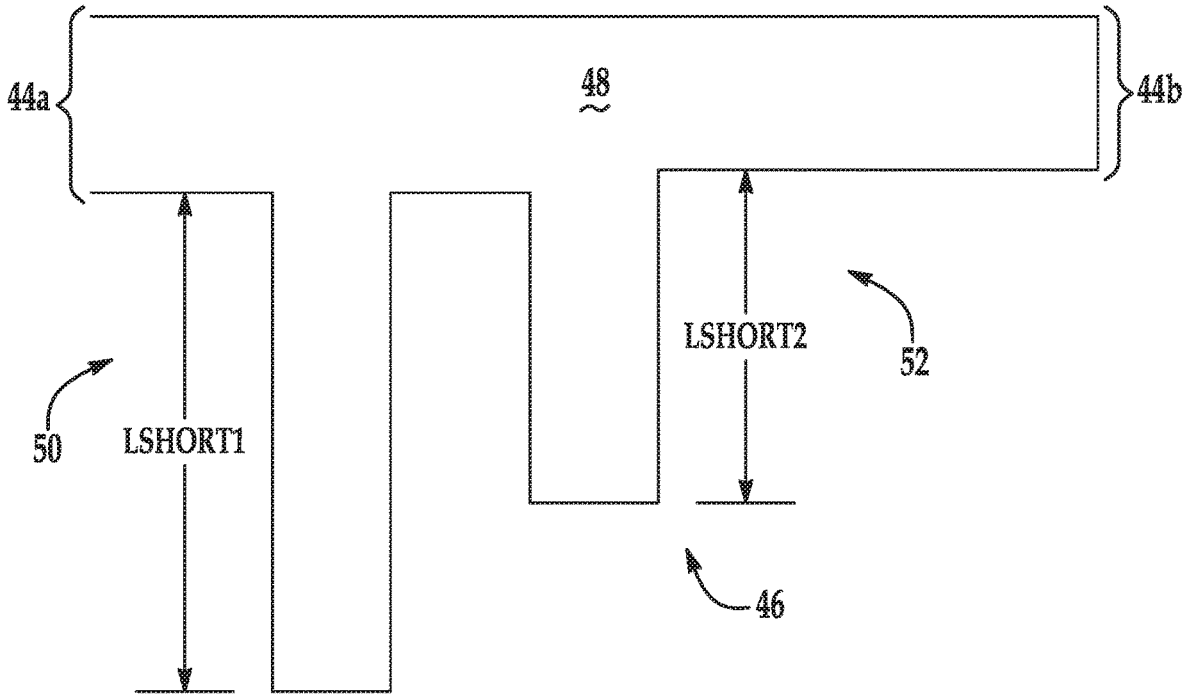
FIG. 4 is a schematic diagram illustrating a dual-band choke connected to and partitioning adjacent parallel plate transmission lines of a VICTS array in accordance with an embodiment of the invention.

Referring briefly to FIG. 4, electrical characteristics of the choke 46 are shown. In one embodiment, the choke 46 includes a section of transmission line 48 (e.g., a parallel-plate transmission line) loaded with two shorted transmission line sections 50, 52 of length Lshort1 and Lshort2. The choke 46 mechanically connects but electrically isolates the parallel plate regions between the first parallel plate transmission line portion 44*a* and the second parallel plate transmission line portion 44*b*. The choke 46 minimizes signals from either band BW1 or band BW2 transiting to the second parallel plate transmission line portion 44*b* or the first parallel plate transmission line portion 44*a*, respectively.

Figure 3B:
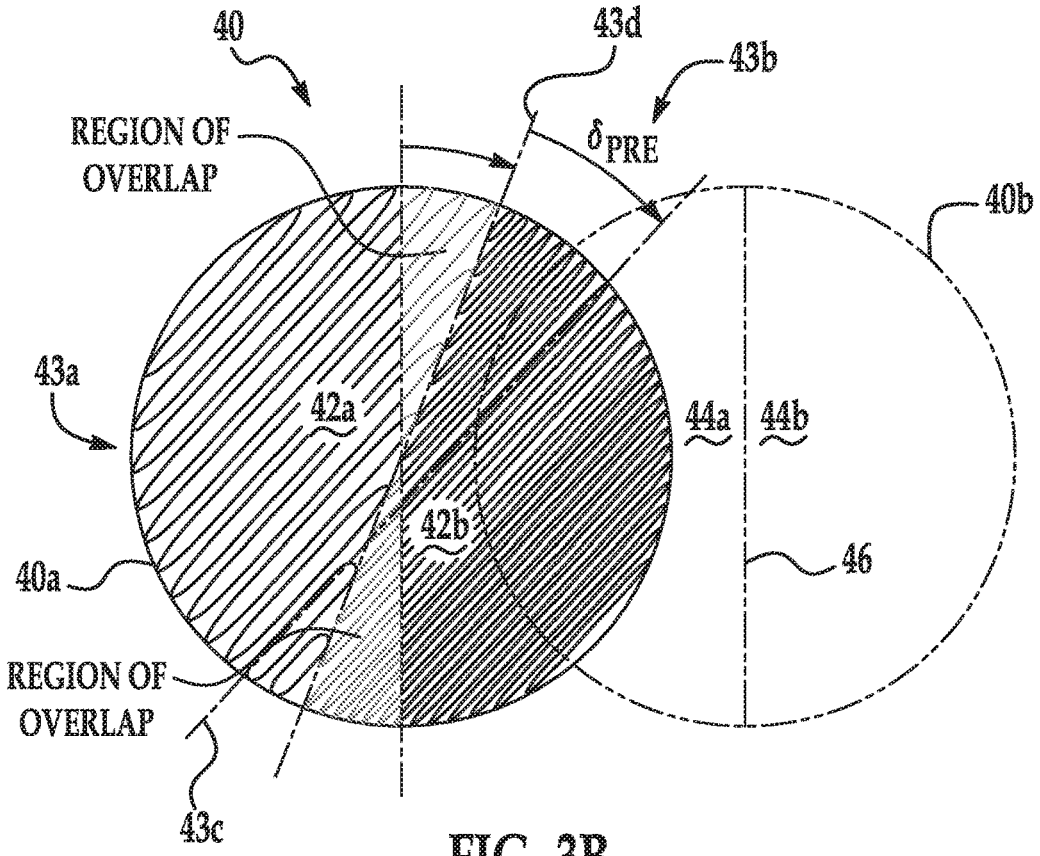
FIG. 3B is an exploded view of the two-region VICTS array of FIG. 3A with clockwise aperture rotation showing overlap.
Figure 3C:
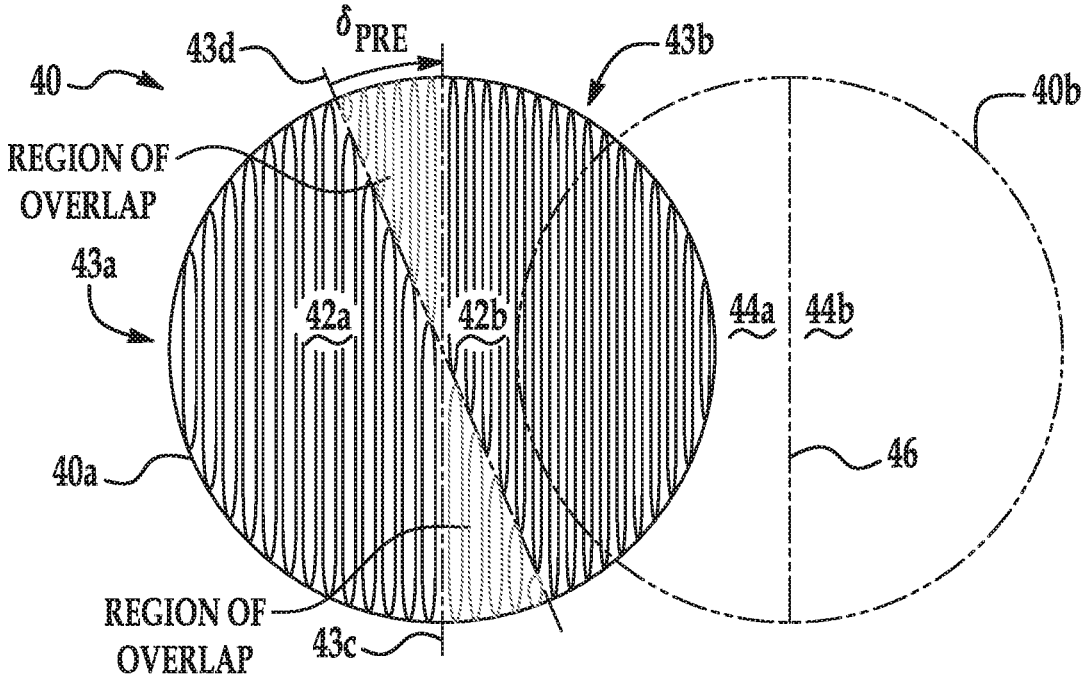
FIG. 3C is an exploded view of the two-region VICTS array of FIG. 3A with counter-clockwise aperture rotation showing overlap.
Figure 5:
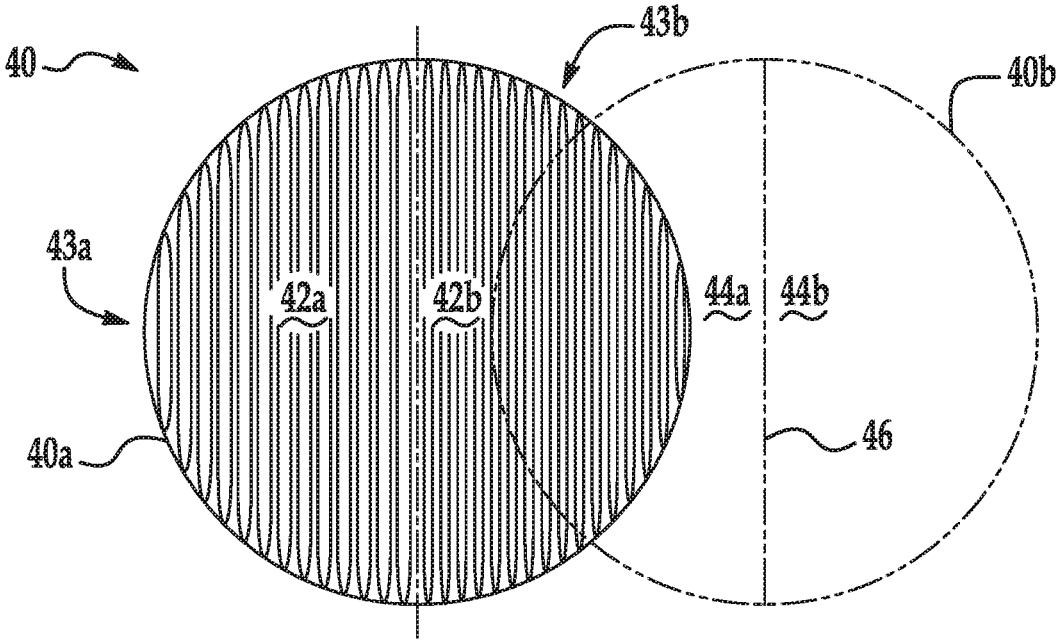
FIG. 5 is an exploded view of the two-region VICTS array with no overlap in accordance with an embodiment of the invention.

As seen in FIG. 3A, the CTS radiators 43*a*, 43*b* in both the first and second aperture regions 42*a*, 42*b* are pre-rotated by $\alpha_{pre}$ degrees (the arrow showing the direction of aperture rotation) with respect to the first and second parallel plate transmission line portions 44*a*, 44*b*. This causes the main beam emanating from each region to be scanned to an angle of $\theta_{nom}$ without physically rotating the aperture relative to the feed (the broadside, or "psi=0" condition). In one embodiment, both aperture regions 42*a*, 42*b* are designed so that their main beams are co-aligned at their respective frequency bands. In another embodiment, the aperture regions 42*a*, 42*b* are designed so that their main beams are not co-aligned at their respective frequency bands. Rotating the first conductive plate structure 40*a* clockwise or counter-clockwise with respect to the second conductive parallel plate structure 40*b* causes part of the first aperture region 42*a* to overlap above second parallel plate transmission line portion 44*b* and part of the second aperture region 42*b* to overlap above the first parallel plate transmission line portion 44*a* as shown in FIGS. 3B and 3C. An additional embodiment may be implemented by setting the pre-rotation angle, $\alpha_{pre}$, to zero degrees as shown in FIG. 5.

Figure 6:
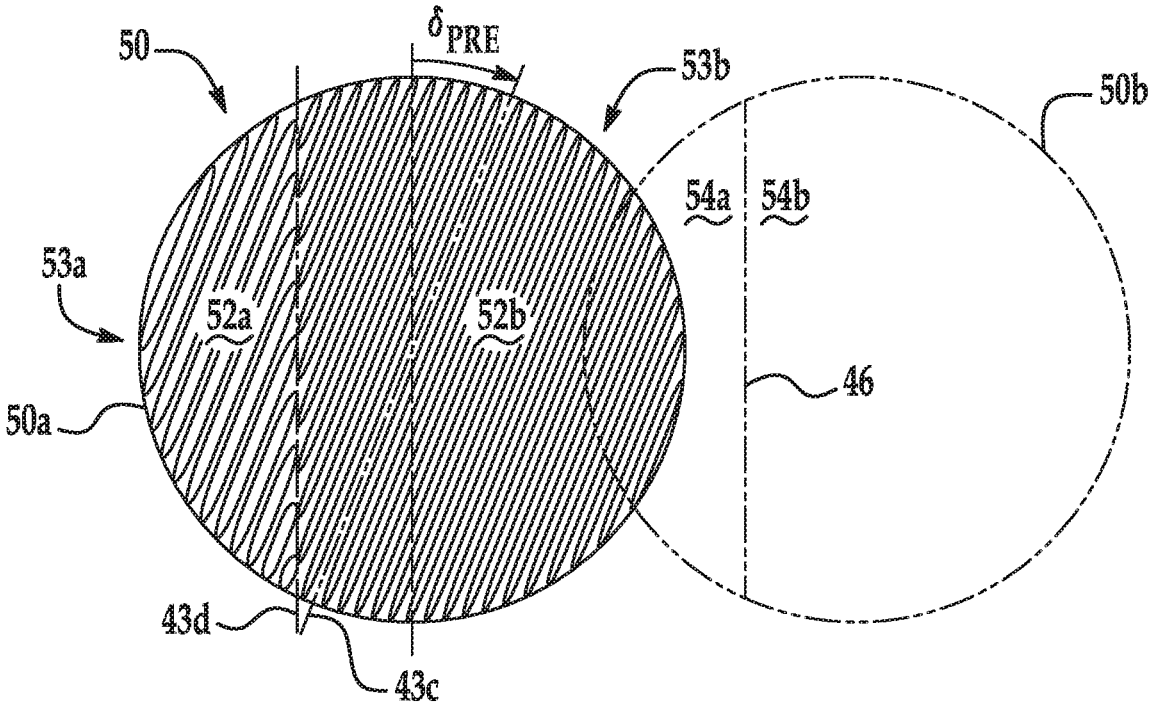
FIG. 6 is an exploded view of a VICTS antenna having two unequal sized regions in accordance with another embodiment of the invention.

Referring now to FIG. 6, illustrated is another embodiment of a VICTS array 50 in accordance with the present invention. The VICTS array 50 includes first and second conductive plate structures 50*a*, 50*b* and is similar to the previously discussed embodiments, except that the first and second parallel plate transmission line portions 54*a*, 54*b* defined on the second conductive plate structure 50*b* have unequal surface areas (i.e., they are different in size), and the first and second aperture regions 52*a*, 52*b* of the first conductive plate structure 50*a* also have unequal surface areas. This difference in surface area can be useful when the performance of one band or polarization is more highly weighted than the other.

In the embodiment of FIG. 6, groups of radiating VICTS aperture elements 53*a*, 53*b* in the respective aperture regions 52*a*, 52*b* are pre-rotated by $\alpha_{pre}$ degrees with respect to the parallel plate transmission line portions 54*a*, 54*b* causing the main beam emanating from each aperture region 52*a*, 52*b* to be scanned to an angle of $\theta_{nom}$ without physically rotating the aperture relative to the feed (psi=0). Further to this embodiment, the CTS radiators immediately to the left of the aperture partition line 43*d* have the same interelement spacing dimension and are part of the smaller first aperture region 52*a*, while those to the right of the partition line have a different interelement spacing and are part of the larger second aperture region 52*b*.

Figure 7:
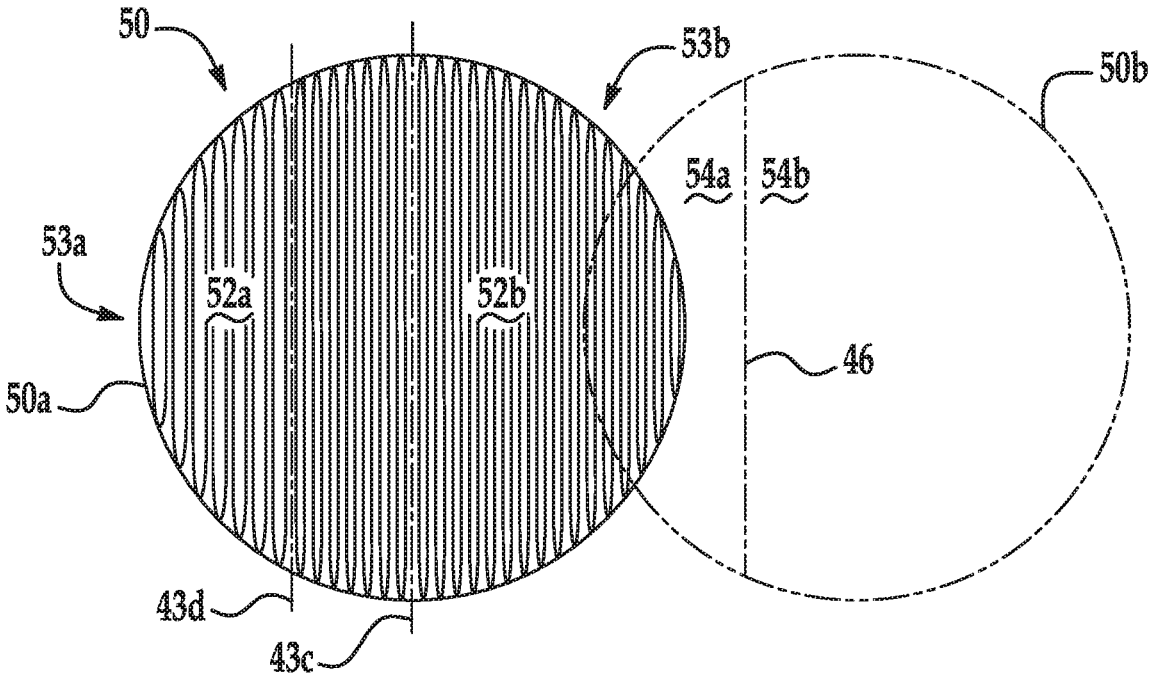
FIG. 7 is an exploded view of a VICTS antenna having two unequal sized regions without overlap in accordance with another embodiment of the invention.

FIG. 7 shows an alternative embodiment with unequal parallel plate transmission line portions and aperture regions implemented by setting the pre-rotation angle, αpre, to zero degrees.

Figure 8:
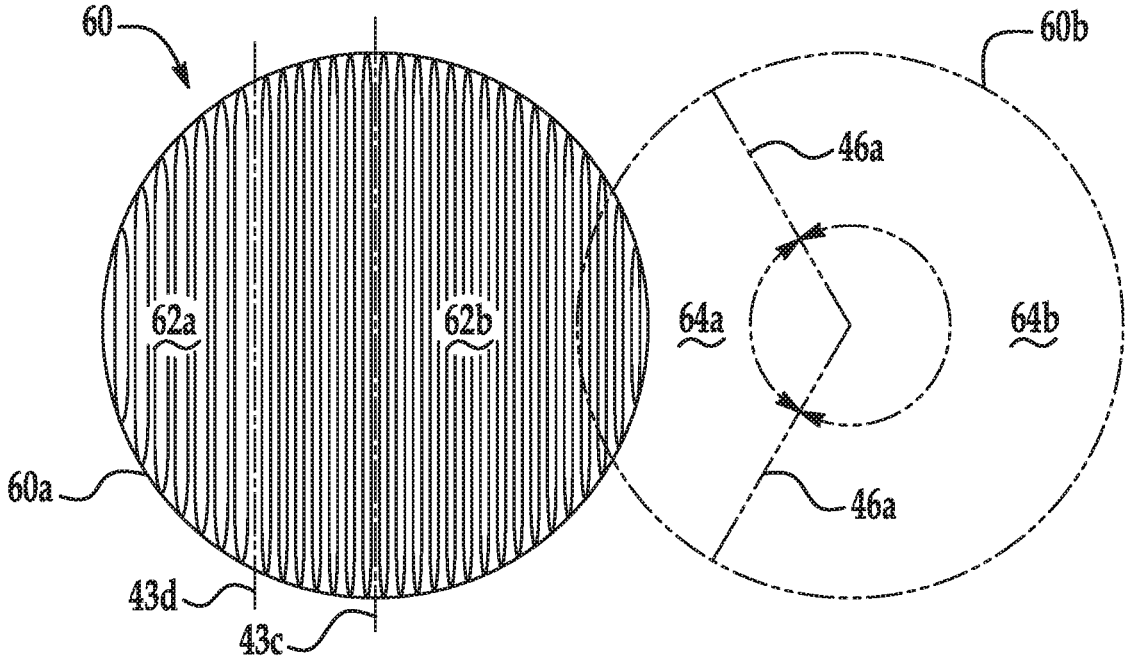
FIG. 8 is an exploded view of a VICTS antenna having two unequal angular sized parallel-plate regions with the aperture divided into unequal area regions in accordance with another embodiment of the invention.

Referring now to FIG. 8, illustrated is another embodiment of a VICTS array 60 in accordance with the present invention. In the embodiment of FIG. 8, the first and second parallel plate transmission line portions 64*a*, 64*b* are defined over different angular area segments on the second conductive plate structure 60*b* (the angular extent of the first parallel plate transmission line portion 64*a* being smaller than the angular extent of the second parallel plate transmission line portion 64*b*). To define the parallel plate transmission line portions with different angular area segments, a choke 46*a* having a V-shape may be arranged on the second conductive plate comprising a V-shape. The V-shape choke 46*a* can span to the outer radial edges of the second conductive plate structure 60*b*. Additionally, in the embodiment of FIG. 8 the area of the first and second aperture regions 62*a*, 62*b* is also unequal on the first conductive plate structure 60*a*.

Figure 9:
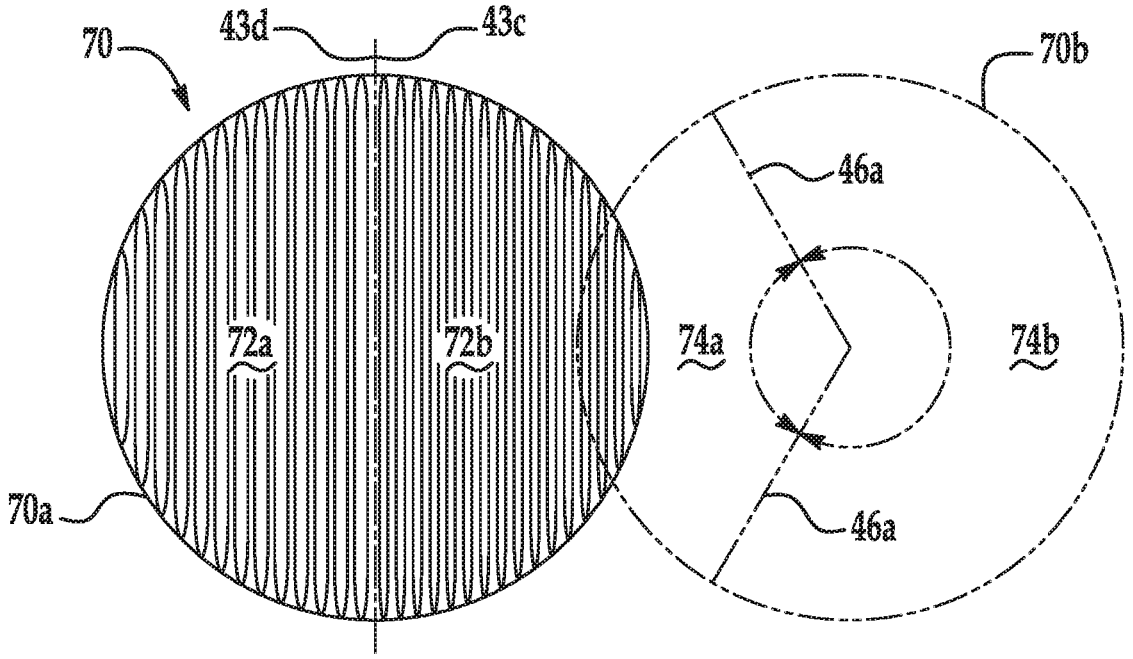
FIG. 9 is an exploded view of a VICTS array having two unequal angular sized parallel-plate regions with the aperture divided into equal area regions in accordance with another embodiment of the invention.

FIG. 9 illustrates a VICTS array 70 that is a variation of the embodiment of FIG. 8, where the first and second parallel plate transmission line portions 74*a*, 74*b* defined on the second conductive plate structure 70*b* are implemented over different angular area segments as in the embodiment of FIG. 8 (the angular extent of the first parallel plate transmission line portion 74*a* being smaller than the angular extent of the second parallel plate transmission line portion 74*b*). However, the first and second aperture regions 72*a*, 72*b* of the first conductive plate structure 70*a* are equal in area.

Figure 10:
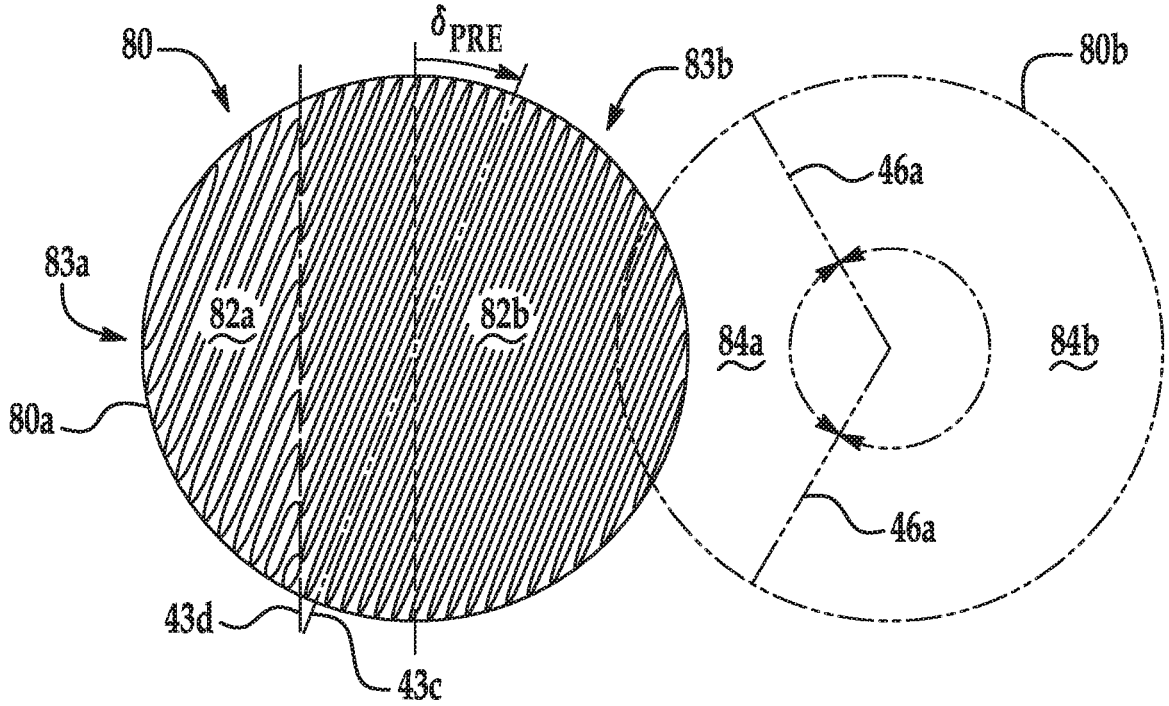
FIG. 10 is an exploded view of a VICTS array having two unequal angular sized parallel-plate regions with the aperture divided into unequal area regions and VICTS elements in both regions pre-rotated $\alpha_{pre}$ degrees in accordance with another embodiment of the invention.

In another embodiment, illustrated in FIG. 10, a VICTS array 80 has first and second parallel plate transmission line portions 84*a*, 84*b* defined on the second conductive plate structure 80*b* implemented over different angular area segments, as in the embodiments of FIGS. 8 and 9. Additionally, the area of the first and second aperture regions 82*a*, 82*b* on the first conductive plate structure 80*a* are unequal, with the VICTS aperture elements 83*a*, 83*b* in both regions pre-rotated by $\alpha_{pre}$ degrees with respect to the parallel plate transmission line portions 84*a*, 84*b*. This causes the main beam emanating from each region to be scanned to an angle of $\theta_{nom}$ without physically rotating the aperture relative to the parallel plate transmission line portions (psi=0).

Figure 11:
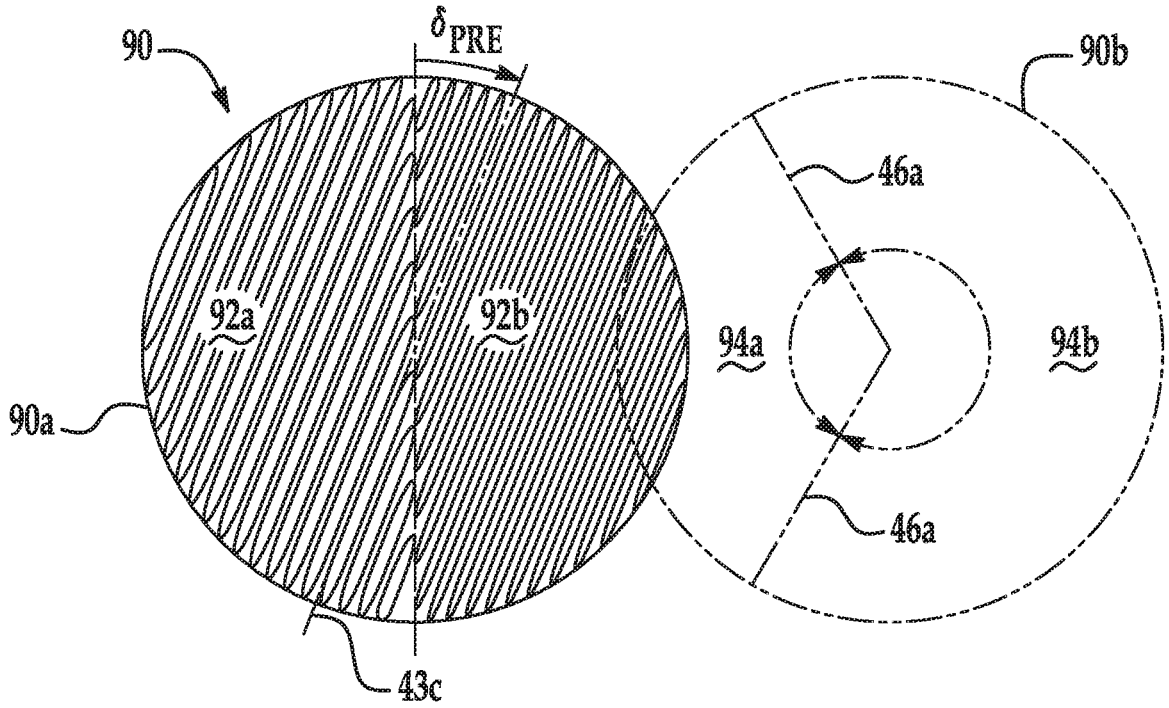
FIG. 11 is an exploded view of a VICTS array having two unequal angular sized parallel-plate regions with the aperture divided into equal area regions and VICTS elements in both regions pre-rotated $\alpha_{pre}$ degrees in accordance with another embodiment of the invention.

Referring to FIG. 11, in another embodiment the first and second parallel plate transmission line portions 94*a*, 94*b* defined on the second conductive plate structure 90*b* are implemented over different angular area segments, and the area of the first and second aperture regions 92*a*, 92*b* of the first conductive plate structure 90*a* are equal with the VICTS aperture elements in both aperture regions pre-rotated by $\alpha_{pre}$ degrees with respect to the first and second parallel plate transmission line portions, causing the main beam emanating from each region to be scanned to an angle of $\theta_{nom}$ without physically rotating the aperture relative to the feed (psi=0).

It is noted that the number, size, and shape of both the aperture and parallel plate transmission line portions for all embodiments depicted in FIGS. 3A-3C and 5-11 can be unique. Other embodiments that employ a different number of aperture regions and/or parallel plate transmission line portions and/or different size and different shaped aperture regions and/or parallel plate transmission line portions form additional embodiments that fall within the scope of the invention.

Figure 12:
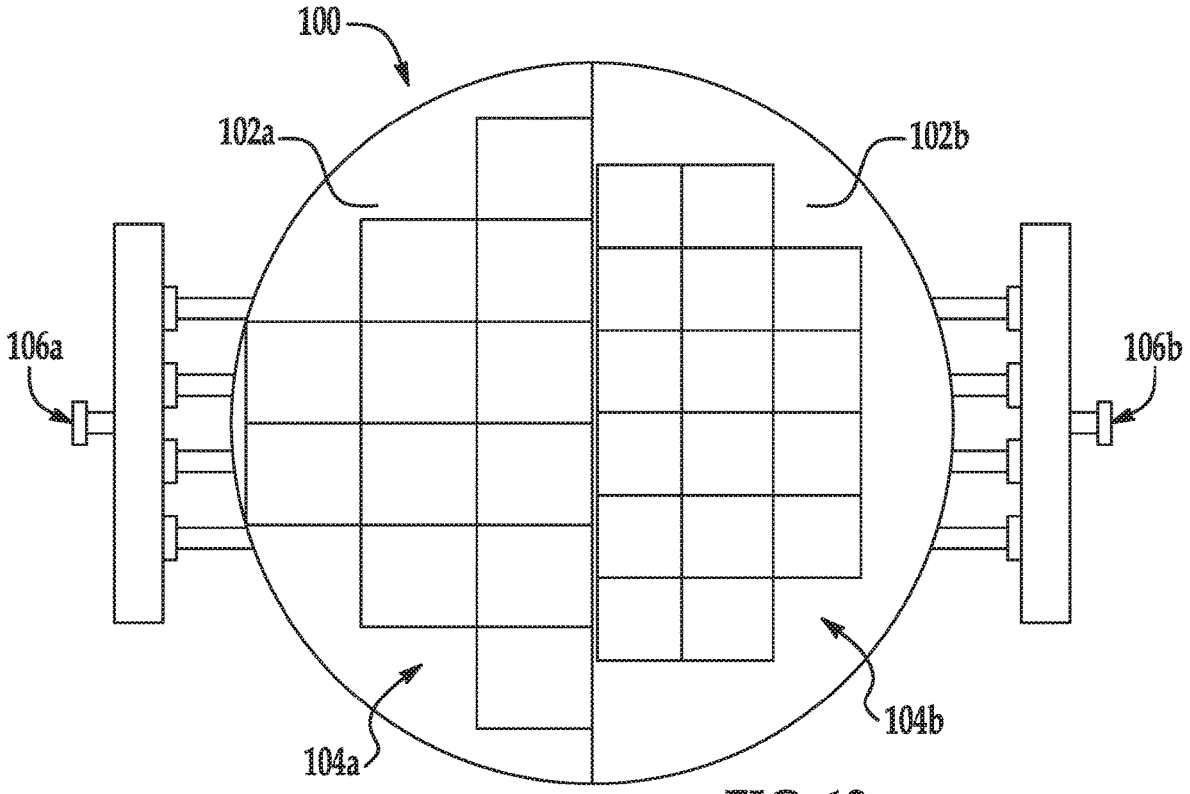
FIG. 12 is a schematic diagram illustrating an equal area split feed partitioned into subarrays in accordance with the invention.
Figure 13:
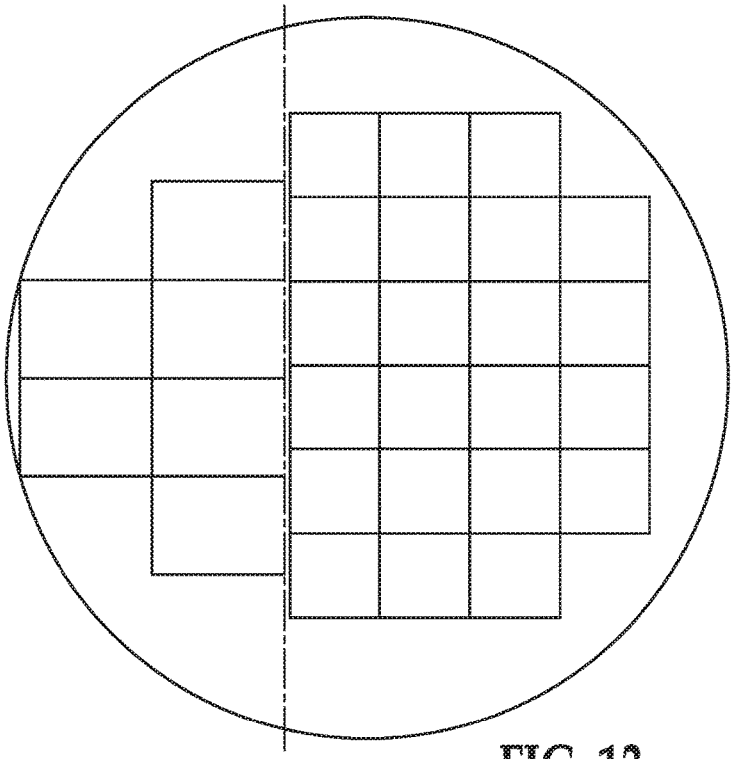
FIG. 13 is a schematic diagram illustrating an unequal area split feed partitioned into subarrays in accordance with the invention.
Figure 14:
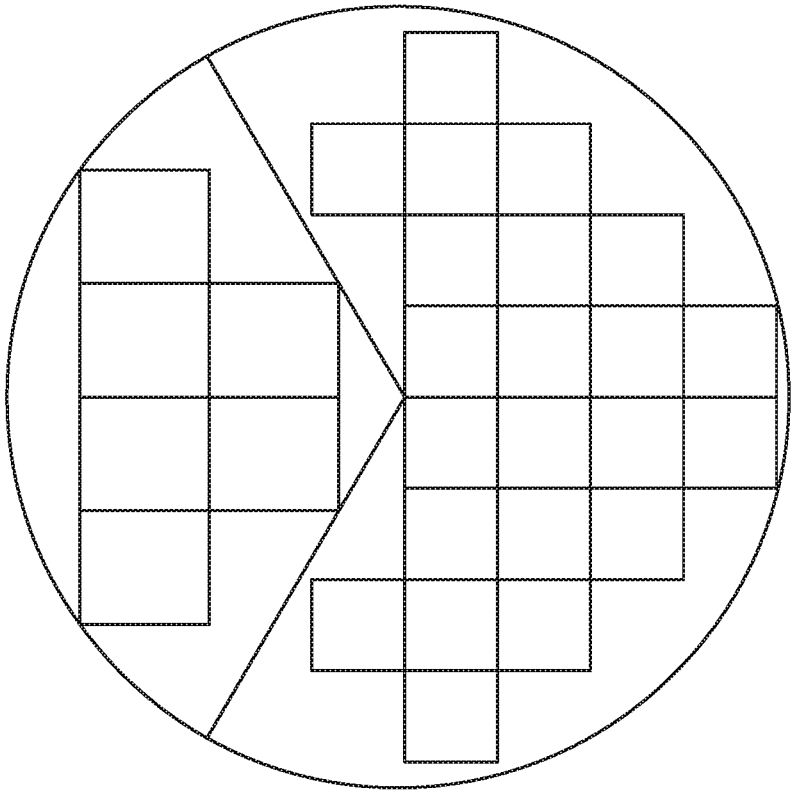
FIG. 14 is a schematic diagram illustrating an unequal angular area split feed partitioned into subarrays in accordance with the invention.

Referring now to FIGS. 12-14, the exemplary feed regions for various configurations of a VICTS array are illustrated. As shown, each parallel plate transmission line portion is partitioned into a number of feed subarrays with each subarray acting as an independent parallel plate feed. The subarrays in each parallel plate transmission line portion are combined and fed with a separate corporate feed that provides optimum amplitude and phase to each subarray.

FIG. 12 illustrates a typical embodiment of a feed 100 having first and second parallel plate transmission line portions 102*a*, 102*b*, each having one or more subarrays 104*a* (parallel plate subarrays 1-12), 104*b* (parallel plate subarrays 13-28) in each parallel plate transmission line portion. The subarray or subarrays 104*a* in the first parallel plate transmission line portion 102*a* are communicatively coupled to a first corporate feed 106*a* (also referred to as a first port), the combination servicing a first frequency band BW1, and the subarray or subarrays 104*b* in the second parallel plate transmission line portions 102*b* are communicatively coupled to a second corporate feed 106*b* (also referred to as a second port), the combination servicing a second frequency band BW2. The subarrays 104*a*, 104*b* and corporate feed 106*a*, 106*b* can be designed to have enhanced instantaneous bandwidth properties. FIGS. 13 and 14 illustrate exemplary embodiments in which unequal size parallel plate transmission line portions may be fed via subarrays. FIG. 13 includes parallel-plate subarrays 104*a* (1-6) to the left of the parallel plate split line and parallel plate subarrays 104*b* (7-28) to the right of the parallel plate split line, while FIG. 14 includes parallel-plate subarrays 104*a* (1-6) to the left of the parallel plate split line and parallel plate subarrays 104*b* (7-22) to the right of the parallel plate split line. It is noted that the embodiments of FIGS. 12-14 are merely exemplary, and additional embodiments may be created by changing the size, number, shape, and position arrangement of the subarrays. Additionally, each partitioned aperture described herein (see FIGS. 3A-3C and 5-11) can be individually combined with the subarray feeds described in FIGS. 12-14 to from unique embodiments.

Figure 15A:
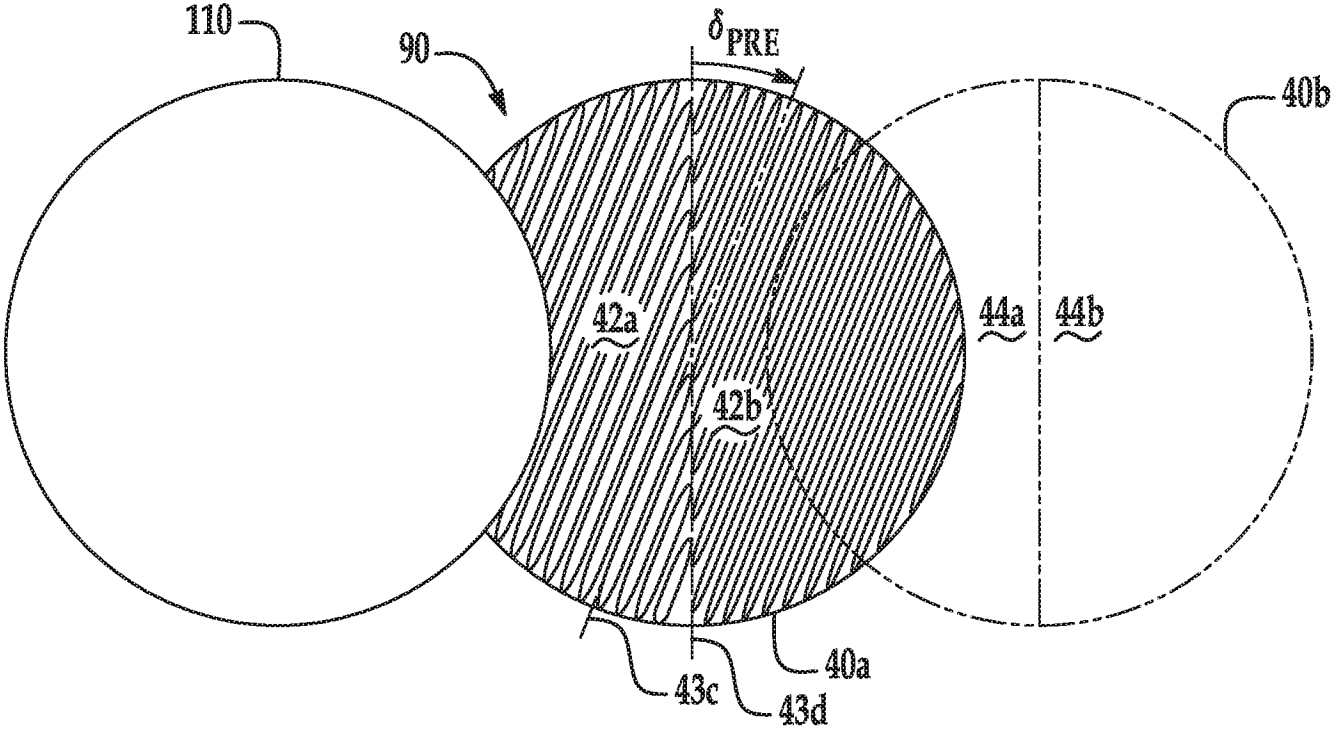
FIG. 15A is an exploded view of an array having two parallel-plate regions with a single generic polarizer added to an equal area split VICTS configuration in accordance with an embodiment of the invention.

Additional embodiments can be achieved by adding a polarizer to any of the previously described embodiments. FIG. 15A shows the embodiment of FIG. 3A where a polarizer 110 has been disposed over a first conductive plate structure 40*a* having equal area aperture regions 42*a*, 42*b* and equal area parallel plate transmission line portions 44*a*, 44*b*. In one embodiment, the polarizer 110 converts linearly polarized waves emanating from both regions of the Split VICTS into circularly polarized waves with the same polarization state. In another embodiment, the polarizer 110 twists the linear polarized waves emanating from both regions of the split aperture (e.g., twisting vertical polarized waves to horizontal polarized waves).

Figure 15B:
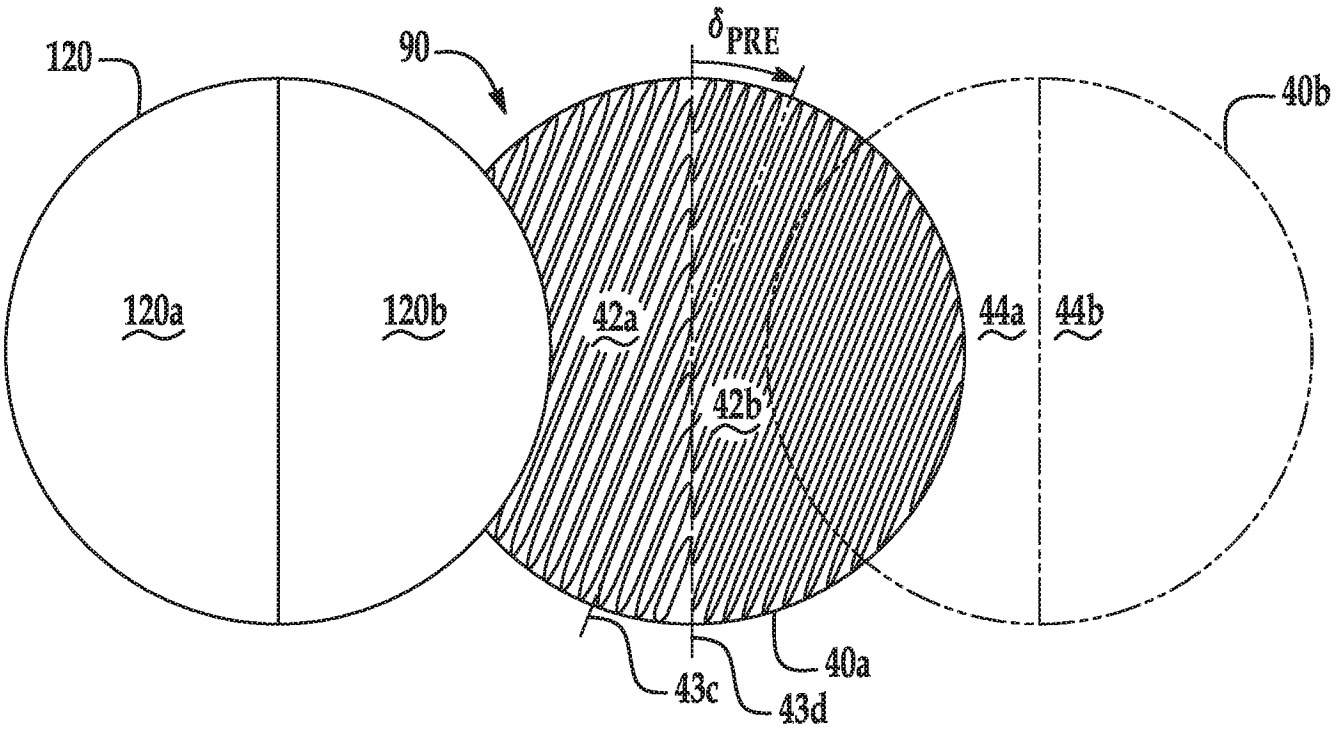
FIG. 15B is an exploded view of an array having two parallel-plate regions with a generic two-region polarizer added to an equal area split VICTS configuration in accordance with an embodiment of the invention.

FIG. 15B shows the embodiment from FIG. 3A with a split region generic polarizer 120 added. The split region polarizer 120 in this embodiment includes two independent generic polarizer regions 120*a*, 120*b* combined into one entity. In one embodiment, the split generic polarizer 120 is fixed with respect to the first conductive plate structure 40*a* so that the waves emanating from each unique aperture region 42*a*, 42*b* are always incident upon a single fixed generic polarizer region 120*a*, 120*b* independent of the position of the parallel plate transmission line portions. In another embodiment the split generic polarizer 120 is fixed with respect to the second conductive plate structure 40*b* so that waves emanating from each unique parallel plate transmission line portion 44*a*, 44*b* are always incident upon a single fixed generic polarizer region 120*a*, 120*b* independent of the position of the first conductive plate structure 40*a*. For both embodiments, the combination of the first aperture region 42*a*, the first parallel plate transmission line portion 44*a* and the first polarizer region 120*a* can provide circularly polarized performance at one frequency band while the combination of second aperture region 42*b*, the second parallel plate transmission line portion 44*b* and the second polarizer region 120*b* can provide an alternate circular polarization performance at a different frequency band.

In another embodiment, the combination of the first aperture region 42*a*, the first parallel plate transmission line portion 44*a* and the first polarizer region 120*a* can provide twisted linear polarized performance at one frequency band while the combination of second aperture region 42*b*, the second parallel plate transmission line portion 44*b* and the second polarizer region 120*b* can provide an alternate twisted linear polarized performance at a different frequency band. In another embodiment, the combination of the first aperture region 42*a*, the first parallel plate transmission line portion 44*a* and the first polarizer region 120*a* can provide twisted linear polarized performance at one frequency band while the combination of second aperture region 42*b*, the second parallel plate transmission line portion 44*b* and the second polarizer region 120*b* can provide an alternate circularly polarized performance at a different frequency band. In a fourth embodiment, the combination of the first aperture region 42*a*, the first parallel plate transmission line portion 44*a* and the first polarizer region 120*a* can provide circularly polarized performance at one frequency band while the combination of second aperture region 42*b*, the second parallel plate transmission line portion 44*b* and the second polarizer region 120*b* can provide an alternate twisted linear polarized performance at a different frequency band In each embodiment where a polarizer has been added, the polarizer can be designed for optimum performance at the pre-set rotation angle ($\alpha$pre) or at an aperture rotation angle of 0° or at any desired scan angle. The inclusion of a polarizer provides dual frequency band, dual polarized performance in a compact package that possesses all the advantages associated with VICTS antennas.

The novel VICTS array in accordance with the invention achieves optimum performance at two or more different frequency bands simultaneously. Additionally, the antenna main beam position for each band may be co-aligned, and two separate polarization states may be achieved with the split polarizer. The full dual band antenna is realized in single low profile, low part count package.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

What is claimed is:

1. A variable inclination continuous transverse stub (VICTS) antenna, comprising:

a first conductive plate structure comprising a first surface partitioned into a first aperture region and a second aperture region different from the first aperture region, a first group of continuous transverse stub (CTS) radiators arranged on the first aperture region, and a second group of CTS radiators arranged on the second aperture region, wherein a spacing and a width in an E-field direction of the first group of CTS radiators is different with respect to a spacing and a width in the E-field direction of the second group of CTS radiators; and a second conductive plate structure disposed in a spaced relationship relative to the first conductive plate structure, the second conductive plate structure comprising a second surface parallel to the first surface, wherein the second surface is partitioned into a first region and a second region different from the first region, wherein a first parallel plate transmission line portion of the antenna is formed between the first regions of the first and second conductive plate structures, and a second parallel plate transmission line portion different from the first parallel plate transmission line portion is formed between the second regions of the first and second conductive plate structures, the first and second parallel plate transmission line portions configured to receive or output a different radio frequency (RF) signals from one another.

2. The antenna according to claim 1, wherein the first and second group of CTS radiators are arranged on the first and second aperture regions, respectively, to orient a longitudinal axis of the first and second group of CTS radiators at a predefined non-zero angle with respect to a partition line that separates the first aperture region from the second aperture region.

3. The antenna according to claim 1, wherein the first aperture region and the second aperture region are unequal in size.

4. The antenna according to claim 1, wherein a surface area of the first aperture region is unequal to a surface area of the second aperture region.

5. The antenna according to claim 1, further comprising a choke arranged relative to the first and second conductive plate structures, the choke partitioning the second conductive plate structure to define the first and second parallel plate transmission line portions.

6. The antenna according to claim 5, wherein the choke spans an entire length of the second conductive plate structure.

7. The antenna according to claim 5, wherein the choke comprises a V-shape.

8. The antenna according to claim 1, wherein the first parallel plate transmission line portion and the second parallel plate transmission line portion are unequal in size.

9. The antenna according to claim 1, wherein a surface area of the second conductive plate structure defined by the first parallel plate transmission line portion is unequal to a surface area of the second conductive plate structure defined by the second parallel plate transmission line portion.

10. The antenna according to claim 1, wherein the first parallel plate transmission line portion spans a first angular extent and the second parallel plate transmission line portion spans a second angular extent, the second angular extent different from the first angular extent.

11. The antenna according to claim 1, further comprising:

a first port for receiving or outputting a first RF signal; and a first subarray formed on the first parallel plate transmission line portion, the first subarray communicatively coupled to the first port.

12. The antenna according to claim 11, further comprising:

a second port for receiving or outputting a second RF signal; and a second subarray formed on the second parallel plate transmission line portion, the second subarray communicatively coupled to the second port.

13. The antenna according to claim 1, further comprising more than one subarray formed on the first parallel plate transmission line portion communicatively coupled to the first port and more than one subarray formed on the second parallel plate transmission line portion communicatively coupled to the second port.

14. The antenna according to claim 1, further comprising a polarizer disposed over the first conductive plate structure.

15. The antenna according to claim 14, wherein the polarizer includes a first polarizer partition comprising a first type of polarizer, and a second polarizer partition comprising a second type of polarizer different from the first type of polarizer.

16. The antenna according to claim 15 wherein the first type of polarizer comprises a linear-to-left circular polarizer and the second type of polarizer comprises a linear-to-right circular polarizer.

17. The antenna according to claim 1, wherein the first conductive plate and the second conductive plate are concentric with one another.

18. The antenna according to claim 1, wherein the first conductive plate and the second conductive plate are rotatable relative to one another about a common axis.

19. The antenna according to claim 1, wherein the first conductive plate and the second conductive plate comprise a circular form factor.

20. A method of transmitting and receiving multiple RF signals having different frequency bands using the VICTS antenna according to claim 1, the method comprising:

receiving at one of the first parallel plate transmission line portion or the first aperture region a first RF signal having a first frequency band;

receiving at one of the second parallel plate transmission line portion or the second aperture region a second RF signal having a second frequency band that is different from the first frequency band;

communicating the first RF signal between the first parallel plate transmission line portion and the first aperture region;

communicating the second RF signal between the second parallel plate transmission line portion and the second aperture region; and outputting the first RF signal at the other of the first parallel plate transmission line portion or the first aperture region, and outputting the second RF signal at the other of the second parallel plate transmission line portion or the second aperture region.

* * * * *